US010207887B2

(12) United States Patent
Perini

(10) Patent No.: US 10,207,887 B2
(45) Date of Patent: Feb. 19, 2019

(54) METHOD AND DEVICE FOR APPLYING GLUE ON TUBULAR CORES FOR THE PRODUCTION OF PAPER LOGS

(71) Applicant: FUTURA S.P.A., Capannori Fraz. Guamo (IT)

(72) Inventor: Fabio Perini, Viareggio (IT)

(73) Assignee: FUTURA S.P.A., Fraz Guamo (IT)

( * ) Notice: Subject to any disclaimer, the term of this patent is extended or adjusted under 35 U.S.C. 154(b) by 50 days.

(21) Appl. No.: 15/312,823

(22) PCT Filed: Nov. 26, 2014

(86) PCT No.: PCT/IT2014/000314

§ 371 (c)(1),
(2) Date: Nov. 21, 2016

(87) PCT Pub. No.: WO2015/177815

PCT Pub. Date: Nov. 26, 2015

(65) Prior Publication Data

US 2017/0137249 A1 May 18, 2017

(30) Foreign Application Priority Data

May 22, 2014 (IT) ..... FI2014A0119

(51) Int. Cl.

| | |
|---|---|
| ***B65H 19/28*** | (2006.01) |
| ***B65H 19/22*** | (2006.01) |
| ***B65H 19/29*** | (2006.01) |

(52) U.S. Cl.
CPC ..... *B65H 19/283* (2013.01); *B65H 19/2269* (2013.01); *B65H 19/29* (2013.01); *B65H 2301/41427* (2013.01)

(58) Field of Classification Search
None
See application file for complete search history.

(56) References Cited

U.S. PATENT DOCUMENTS

2007/0023562 A1 2/2007 Perini

FOREIGN PATENT DOCUMENTS

| | | | |
|---|---|---|---|
| EP | 1 519 886 | A1 | 4/2005 |
| EP | 1 519 886 | B1 | 4/2006 |
| WO | 2004005173 | A1 | 1/2004 |
| WO | 2004/096684 | A2 | 11/2004 |

*Primary Examiner* — Xiao S Zhao
(74) *Attorney, Agent, or Firm* — McGlew and Tuttle, P.C.

(57) ABSTRACT

Method for applying glue on tubular cores for the production of logs of paper material, comprising the step of supplying in sequence more tubular cores (1) along a predetermined advancing direction (A) and the step of applying on each of said cores (1) a predetermined amount of glue on a first point (P6) and on a second point (P7). The method further comprises a step of orienting the glue (G6) applied on the first point (P6) towards the second point (P7) and along said advancing direction (A), and orienting the glue (G7) applied on the second point (P7) towards the first point (P6) and along a direction opposite relative to said advancing direction (A).

20 Claims, 10 Drawing Sheets

METHOD AND DEVICE FOR APPLYING GLUE ON TUBULAR CORES FOR THE PRODUCTION OF PAPER LOGS

The present invention relates to a method and a device for applying glue on cardboard tubular cores within rewinding machines for the production of paper rolls or "logs".

It is known that the production of logs of paper material, from which are obtained, for example, rolls of toilet paper or rolls of kitchen paper, involves a step of feeding a paper web, formed by one or more superimposed plies, on a predetermined path along which various operations are performed before proceeding to the formation of the logs, including a pre-transverse incision of the web to form pre-cut lines that divide it into separable sheets. The formation of logs implies the use of cardboard tubes, commonly called "cores", on whose surface it is distributed a predetermined quantity of glue to enable the bonding of the paper web on the cores progressively introduced into the machine that produces the logs, said machine being commonly said "rewinder". The formation of logs implies, moreover, the use of winding rollers downstream of the glue distribution station, which oblige each core to rotate about its longitudinal axis thus causing the winding of the web on the core. The process ends when a predetermined number of sheets is wound on the core, with the bonding of a flap of the last sheet on the underlying one of the roll thus formed ("flap closing" operation). At this point, the log is discharged from the rewinder. EP1519886 discloses a rewinder working as disclosed above.

In some cases, the glue may soil the paper reducing the commercial value of the finished product.

The main purpose of the present invention is to eliminate the above drawback.

This result is achieved, according to the present invention, by adopting the idea of implementing a method of operating and to provide a device having the characteristics indicated in the independent claims. Other features of the present invention are the subject of the dependent claims.

Thanks to the present invention, it is possible to impose to the glue distributed on tubular cores a predefined shaping which avoids the drawbacks of the known machines, allowing to produce logs of better commercial quality. Furthermore, a device in accordance with the present invention is structurally and functionally simple and, therefore, very economical in relation to the advantages offered.

These and other advantages and features of this invention will be best understood by anyone skilled in the art thanks to the following description and to the accompanying drawings, given by way of example but not to be considered in a limiting sense, in which.

Figure 1:
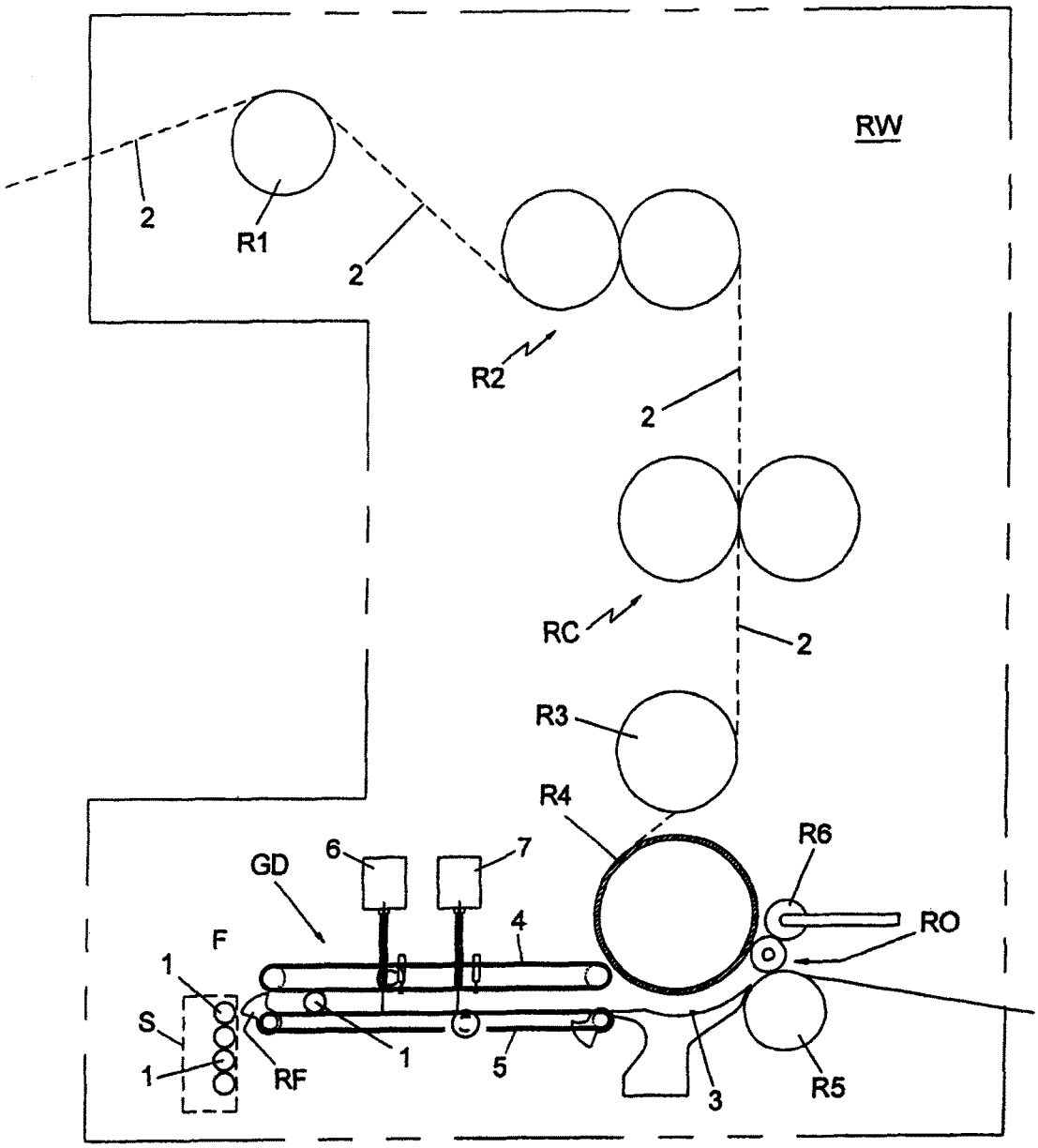
FIG. 1 is a schematic side view of a rewinder provided with a device according to the present invention.
Figure 2:
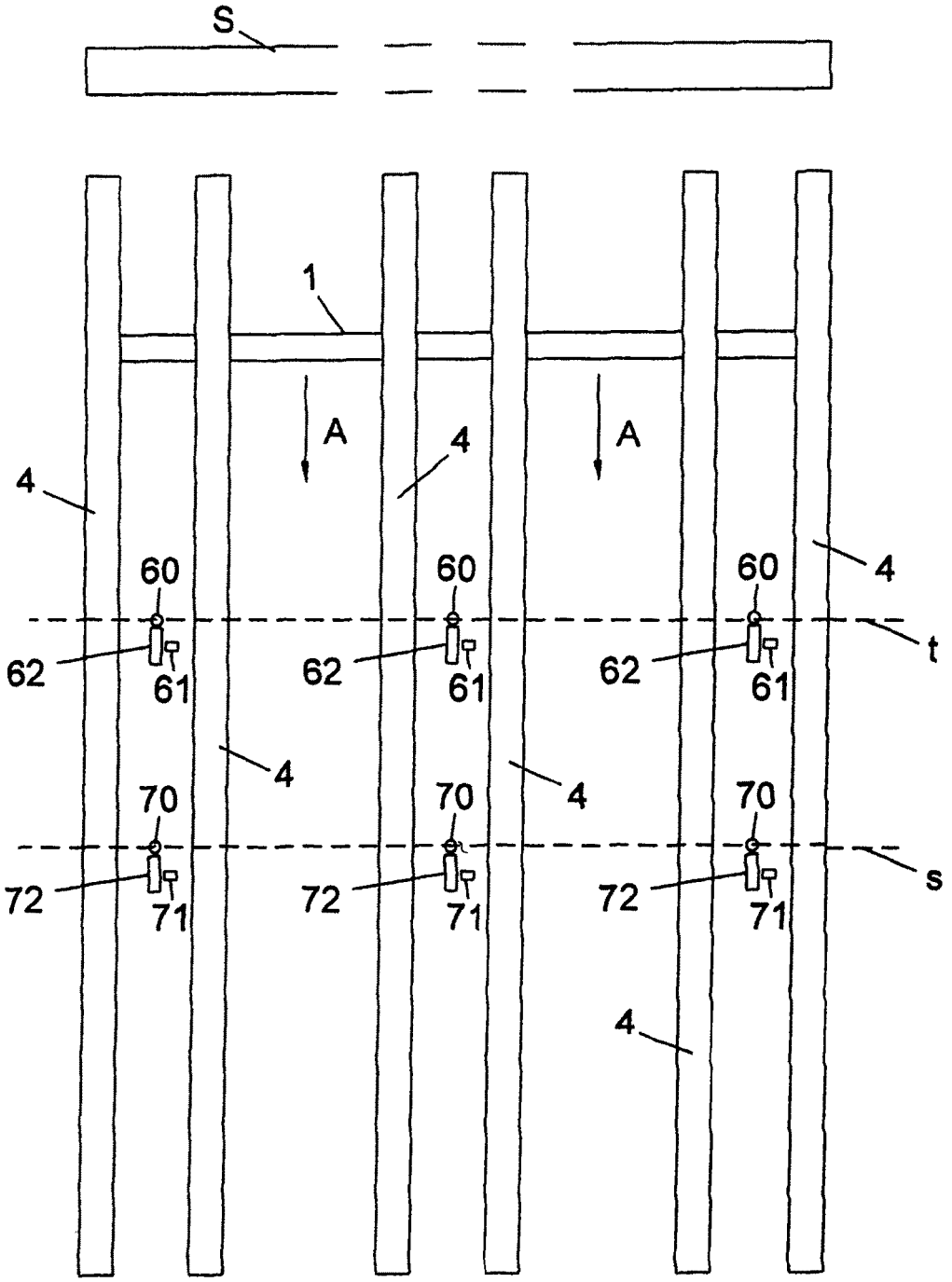
FIG. 2 is a schematic view from the above of a device according to the present invention with some parts omitted to better show other parts.

A device according to the present invention can be used, for example, in a rewinder or rewinding machine (RW) comprising:

a feeding station (F) for feeding the cores (1) coming from a store (S), wherein there is a rotating feeder (RF) that picks up one core (1) at a time and introduces it in the gluing device (GD) disclosed below;

means for feeding and transversally pre-cut a paper web (2) formed by one or more superimposed paper plies, with a plurality of guiding rolls (R1, R2, R3) and pre-cutting rolls (RC) provided along path where the paper web (2) is fed and pre-cut;

means for winding the paper web (2) on a core (1) in a winding station, with a first winding roll (R4) provided downstream of said guiding and pre-cutting rolls (R1, R2, R3, RC), and two further vertically aligned winding rolls (R5, R6) positioned and acting close to the first winding roll (R4): the second and the third winding roll (R5, R6) being provided above a curved guide (3) that, in cooperation with the first winding roll (R4), delimit a channel (CH) downstream of the gluing device (GD), said channel (CH) being crossed by the cores (1) that sequentially exit from the gluing device (GD).

The first winding roll (R4) is also intended to guide the paper web (2) coming from the guiding and pre-cutting rolls located above.

The aforementioned channel (CH) delimits the last leg of the path followed by the paper web (2) and also by the cores (1) exiting from the gluing device (GD).

The glueing device (GD) comprises first and second means (G1; G2) for dispensing a predetermined amount of glue on the surface of each of the cores (1) introduced in the same device (GD). The means (G1; G2) are activated in sequence, as further described in the following, to dispense the glue for the so-called flap closing, that is for the bonding of the last sheet (21) of a log (RO) in formation on the underlying sheet of the same log, and for the bonding of the first sheet (20) of a new log on the core (1) of the next log to be formed.

With reference to the example illustrated in the drawings, an apparatus according to the present invention comprises a group of upper belts (4) and a group of lower belts (5) closed in a loop around respective pulleys (40; 50) with horizontal axis, so as to have always two opposing sections (41, 51) that move in the same direction towards the aforementioned channel (CH) placed downstream as indicated by arrows "A". The counter-facing sections (41, 51) of said belts (4, 5) are vertically spaced apart by a value (h) corresponding to the outer diameter of the cores (1).

The belts (4, 5) serve to advance the cores (1) from the feeding station (F) to the channel (CH). The forward movement of the cores (1) between the counter-facing sections (41, 51) of the belts (4, 5) is due to the contact of the cores (1) with such sections of the belts (4, 5) that move in the direction "A". For example, the said belts (4, 5) move with the same speed, so that the cores (1) are subject to translation along the direction "A" when they are between the belts (4, 5).

The first glue delivery means (G1) comprise a tank (6) containing glue and a series of nozzles (60) connected to said tank (6).

Similarly, the second glue delivery means (G2) comprise a tank (7) containing glue and a series of nozzles (70) connected to the respective tank (7).

The second nozzles (70) are downstream of the first nozzles (60) with respect to the advancement direction (A) of the cores (1).

The nozzles (60) of the first series are aligned along a direction (t) perpendicular to said direction (A). Similarly, the nozzles (70) of the second series are aligned along a direction (s) perpendicular to the direction of advancement (A) of the cores (1). Therefore, the nozzles (60, 70) of the first and second series are aligned along two directions (t, s) parallel to each other.

Downstream of each of said nozzles (60, 70) is placed a corresponding photocell (61, 71). In particular, the first photocell (61) is in a position between the first nozzle (60) and the second (70).

Downstream of each of the nozzles (60) of the first series is positioned a motorized wheel with horizontal axis (62) whose diameter is such as to cause its contact with the cores (1) passing between the counter-facing sections (41, 51) of the belts (4, 5). In other words, the lower quadrant (620) of the wheels (62) is slightly below the level of the lower section (41) of the upper belt (4). The axes of said wheels (62) are aligned along a direction parallel to the aforesaid direction (t) and (s).

Upstream of each of the nozzles (70) of the second series is positioned a motorized wheel with horizontal axis (72) whose diameter is such as to cause its contact with the cores (1) passing between the counter-facing sections (41, 51) of the belts (4, 5). In other words, the upper quadrant (720) of the wheels (72) is slightly above the level of the upper section (51) of the lower belt (5). The axes of said wheels (72) are also aligned along a direction parallel to the aforesaid direction (t) and (s). As shown in the drawings, the wheels (62) placed downstream of the nozzles (60) of the first series are positioned with their respective axes between the upper belts (4), while the wheels (72) located upstream of the nozzles (70) of the second series are positioned with their respective axes between the lower belts (5).

The feeder (RF) consists of a body, known per se, made to rotate about a respective horizontal axis which coincides with the axis of the rear pulleys (50) of the lower belts (5).

The device described above also comprises a device (CU) for discharging the cores (1) subjected to gluing. Such device (CU), known per se, is identical to the feeder (RF) and is positioned with its axis coinciding with the axis of the front pulleys (50) of the lower belts (5).

Figure 3:
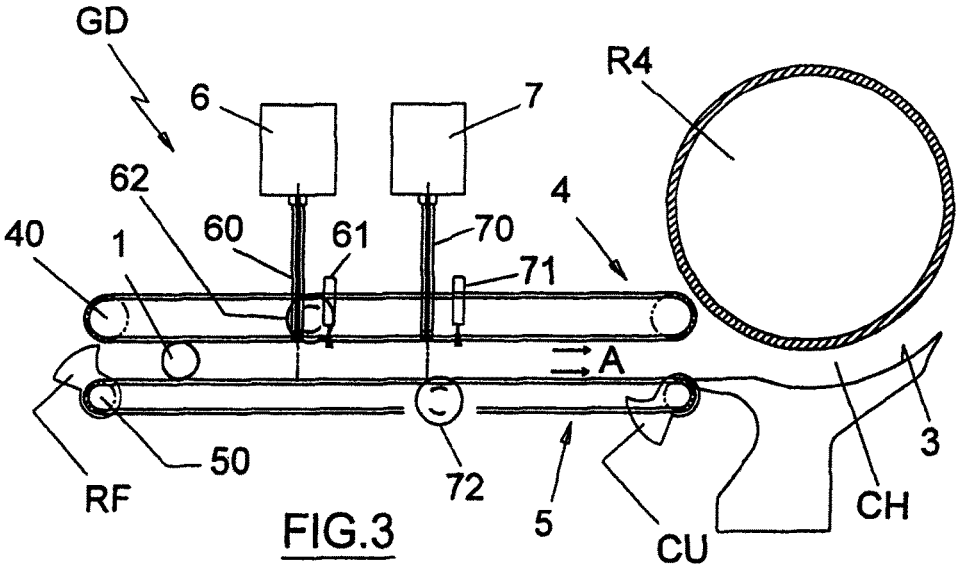
FIGS. 3-11 show a sequence of operative steps concerning the working of a device according to the present invention.
Figure 4:
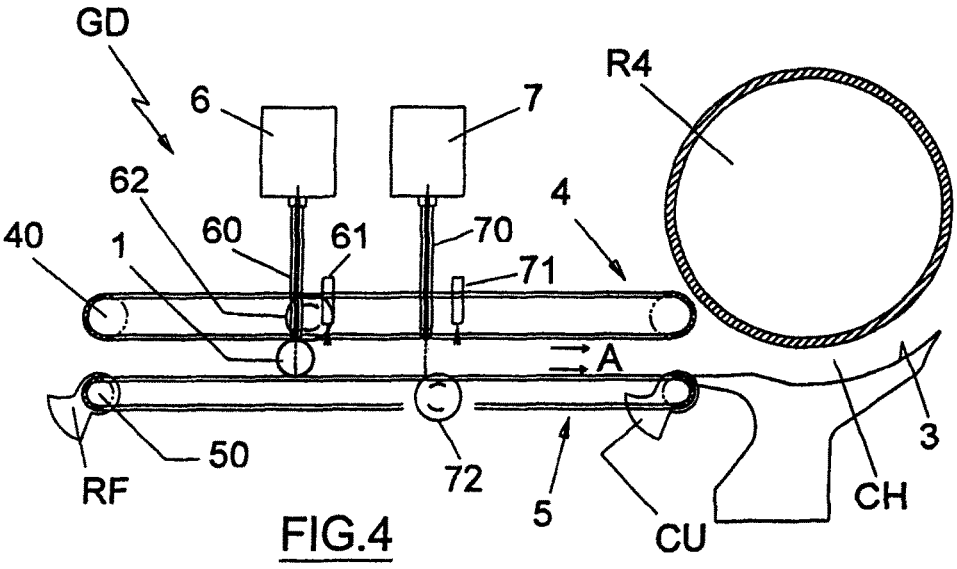
Figure 5:
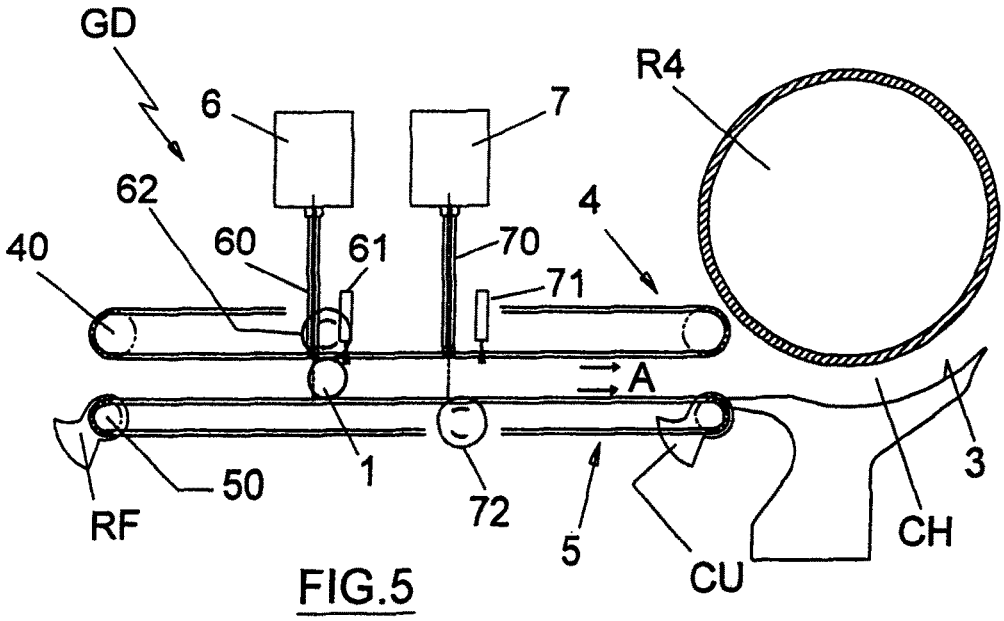
Figure 6:
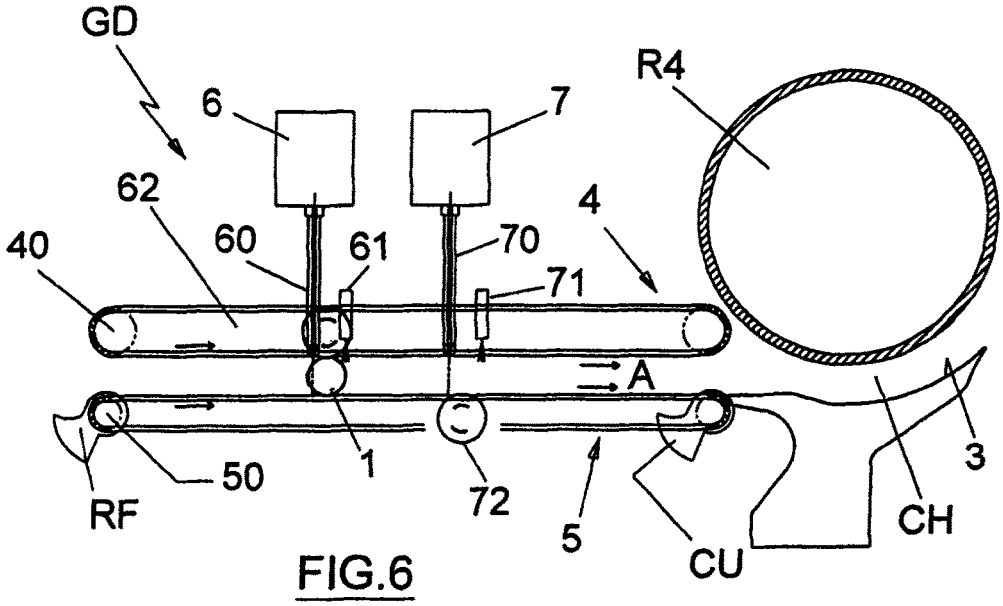
Figure 7:
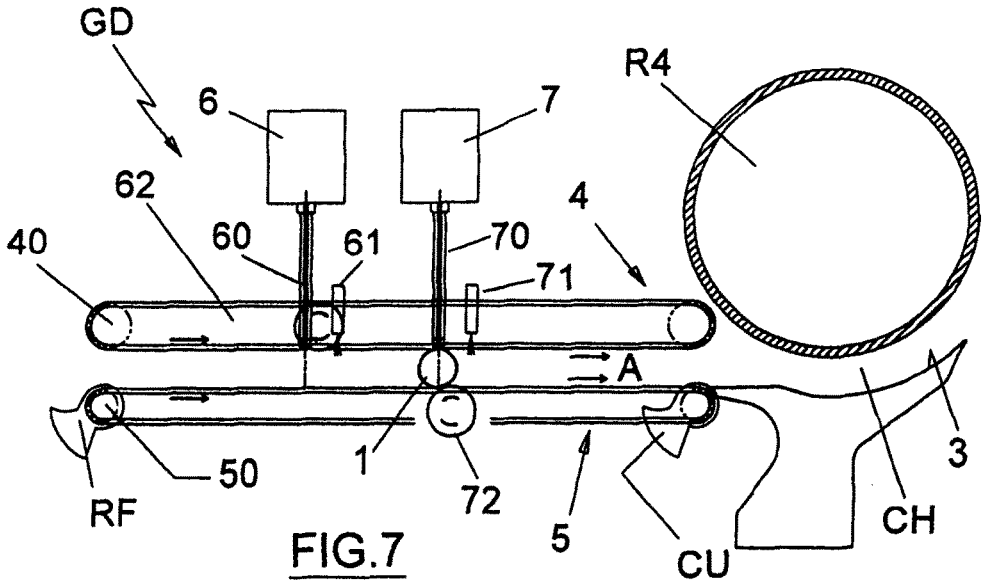
Figure 8:
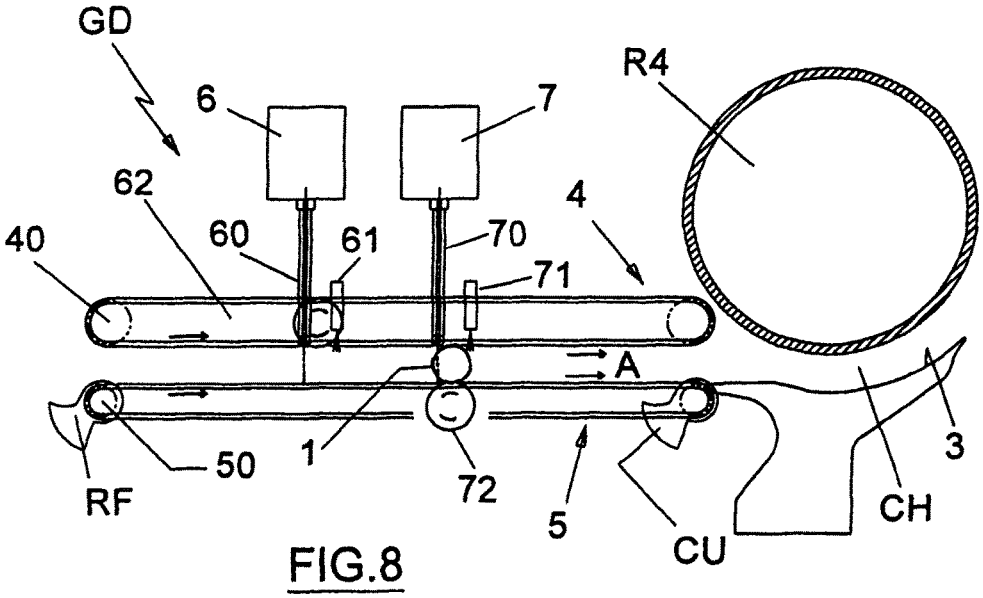
Figure 9:
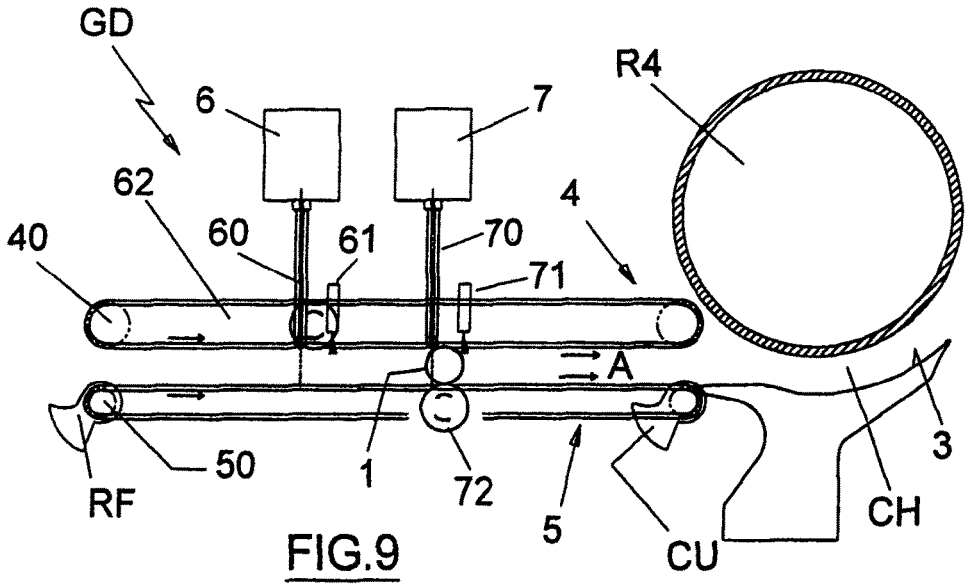
Figure 10:
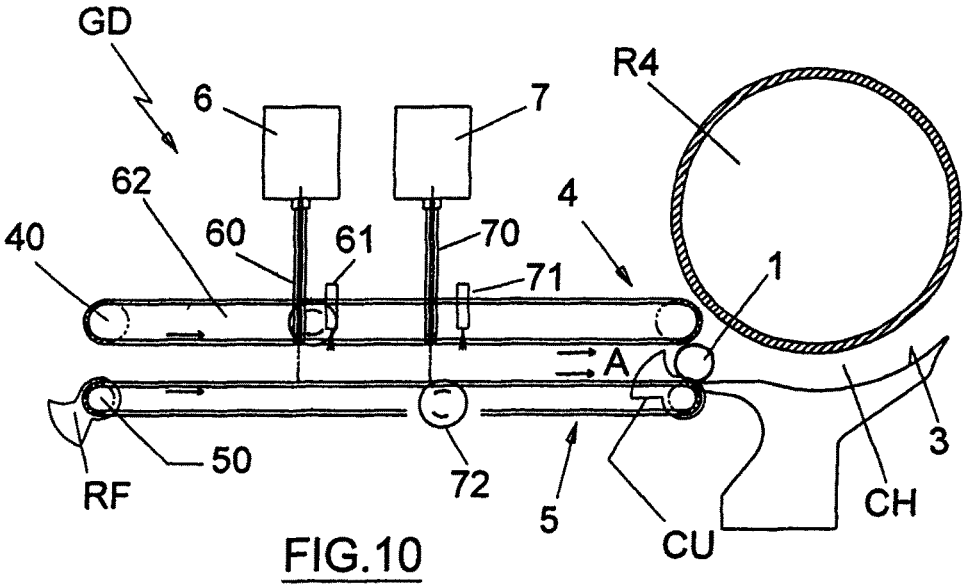
Figure 11:
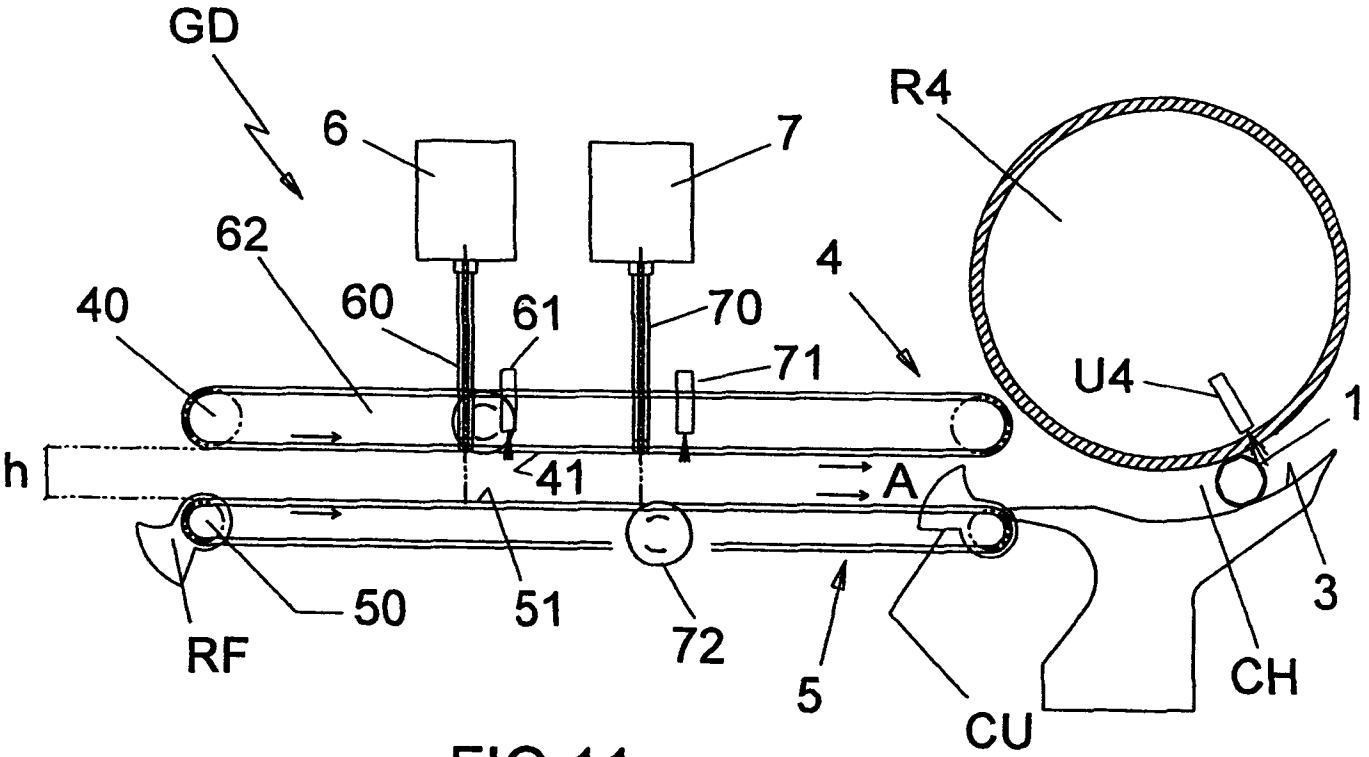
Figure 12:
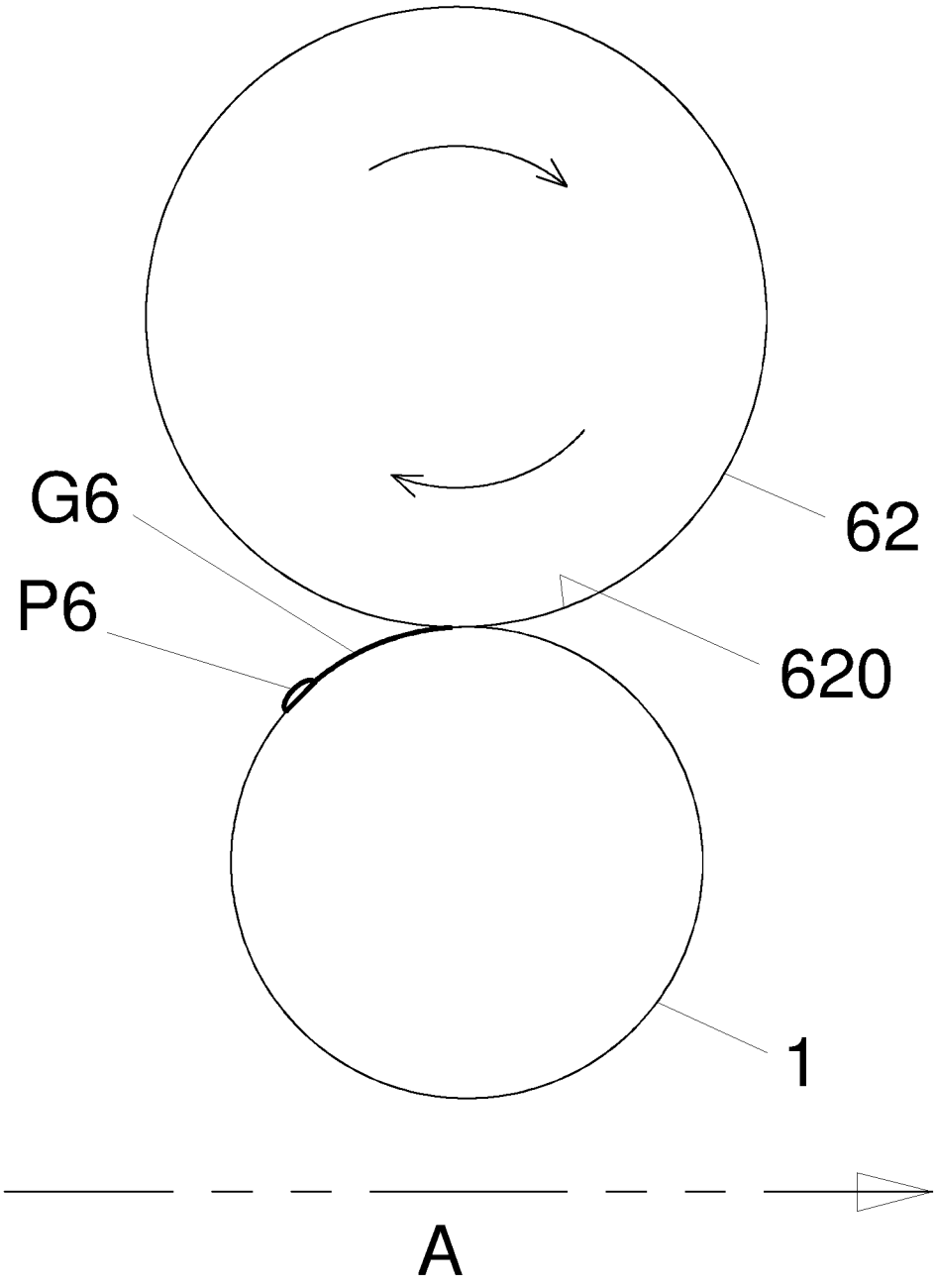
FIGS. 12 and 13 are enlarged details of FIGS. 5 and 8 respectively.

The operation of the device described above is as follows. The feeder (RF) picks up a core (1) from the store (S) and introduces it between the counter-facing sections (41, 51) of the belts (4, 5) which, moving as indicated by arrows "A", oblige the core (1) to advance along the same direction (A) (FIG. 3). When the core (1) arrives in correspondence of the nozzles (60) of the first set, while continuing to advance, receives a predetermined amount of glue from the same nozzles (60) as shown in FIG. 4. The glue delivered by the nozzles (60) of the first series is intended to perform the so-called flap-closing operation, that is, to allow the last sheet of the log (RO) in formation to adhere to the underlying sheet. Then, the core (1) intercepts the optical axis of the photoelectric cells (61) that control (via a control unit not shown in the drawings) the rotation, at an angle of predetermined magnitude, of the wheels (62) inserted between the upper belts (4) in a direction opposite to the advancement direction (A) but with the same peripheral speed of the belts (4, 5), as shown in FIG. 5 and FIG. 6. In this way, since the wheels (62) come into contact with the core (1), the advancement of the latter is temporarily interrupted but the same core (1) rotates about its longitudinal axis. For example, the wheels (62) can be made to rotate by an angle equal to 120° controlled by an encoder acting on the axis of the wheels (62). Consequently, the glue (G6) applied to core (1) by the nozzles (60) together with the glue filaments that necessarily form under the nozzles (60), is forced to orientate downstream with respect to the said direction (A). In other words, the glue (G6) and the filaments that are formed under the nozzles (60) are arranged according to lines directed towards the point (P7) where the nozzles (70) of the second series will apply other glue. The said lines of glue (G6) start from a point (P6) on which the nozzles (60) of the first series have delivered the glue. It is noted that, as a result of the contact with the wheels (62), the rotation of the core (1) is opposite to the advancing direction (A). Subsequently, the wheel (62) releases the core (1) which continues its forward movement (A) towards the corresponding nozzle (70) of the second series (FIG. 7) who apply a predetermined amount of glue to the point (P7). Then, similarly to the previous step, the core (1) intercepts the optical axes of the photocells (71) that drive the rotation of the wheels (72) inserted between the lower belts (5), as shown in FIG. 8 and FIG. 9, in the direction opposite to the advancement direction (A) but with the same peripheral speed of the belts (4, 5). Therefore, the advancement of the core (1) is temporarily interrupted but the core (1) rotates about its longitudinal axis due to its contact with the wheels (72). Thus, the glue (G7) applied on the cores (1) by the nozzles (70) and the glue filaments are forced to orient upstream with respect to said direction (A), that is, are arranged along glue lines (G7) oriented towards the point (P6) where the nozzles (60) of the first series have applied the glue (G6). Due to the contact with the wheels (72), the rotation of the core (1) is concordant with the advancing direction (A) of the cores (1). Subsequently, the wheels (72) release the core (1) that therefore is free to travel towards the discharge apparatus (CU) that guides it in the channel (CH) delimited by the surface (3) and the roll (R4). The rotation of the wheels (72), also controlled by an encoder mounted on the axis of the same, has an angular amplitude chosen in such a way that in the channel (CH), and more precisely at the point where the sheet (2) will be torn, the respective separation line results between the above-mentioned lines of glue (G6) and (G7). For example, the rotation of the wheels (72) is a 70° rotation.

Figure 13:
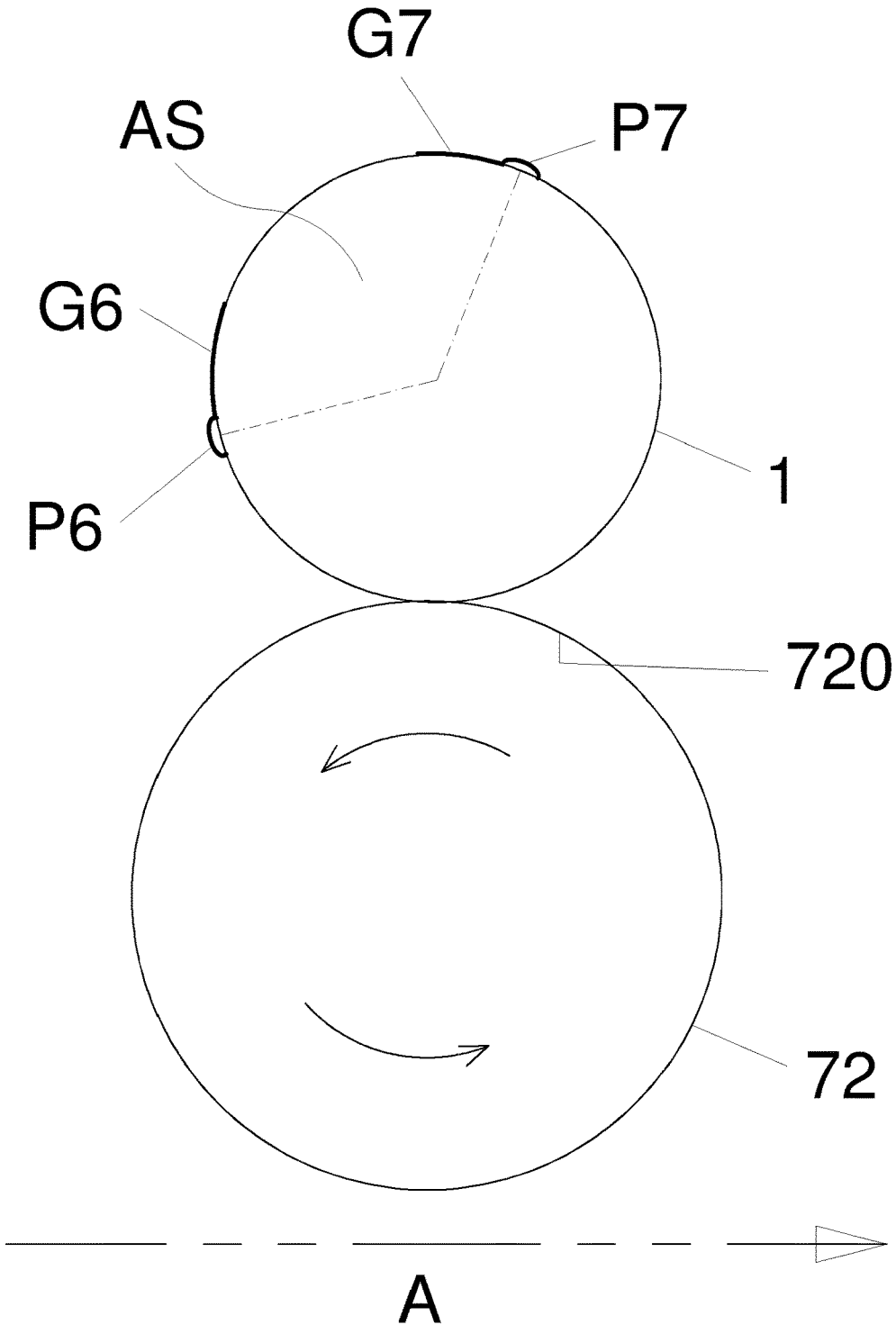
Figure 14:
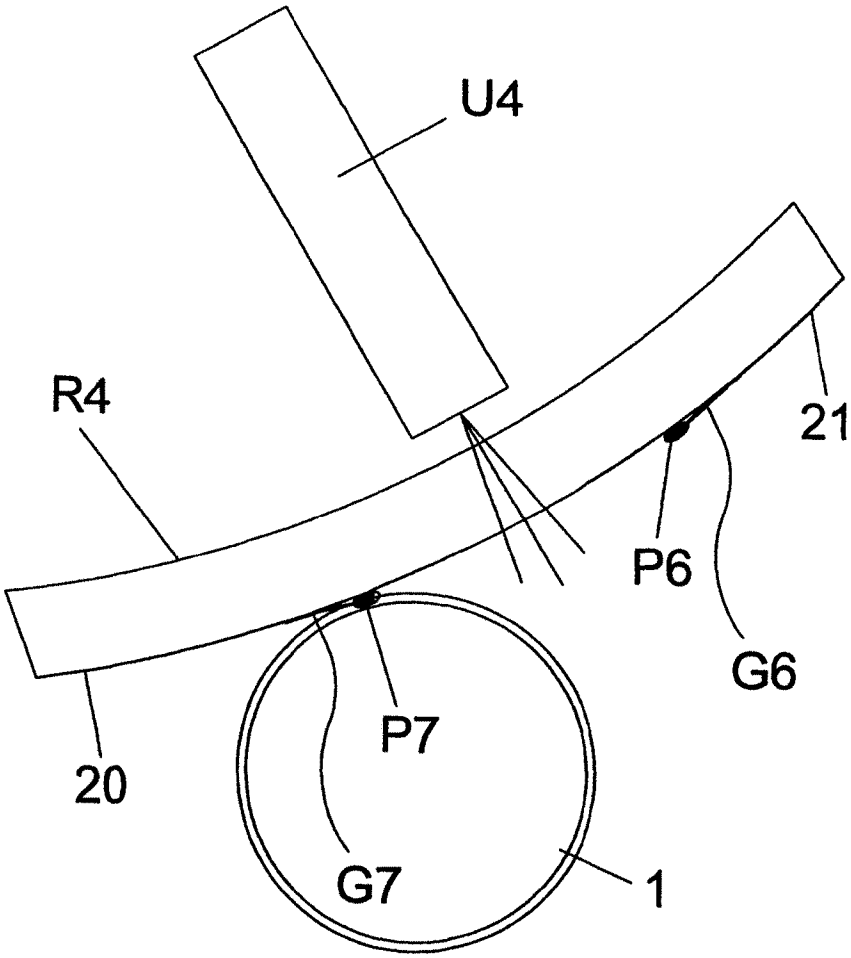
FIG. 14 is an enlarged detail of FIG. 11.

With reference to FIG. 13, it can be observed that the points (P6) and (P7) delimit an angular sector (AS) of the cross section of the core (1) whose angular amplitude is less than 180° and the tails of the glue lines (G6) and (G7) are oriented towards each other. Inside the channel (CH), the core (1) is in contact with the paper web (2) and, since the roller (R4) rotates as indicated by the arrow "F4", the core is obliged to roll along the same channel (CH). The glue (G6) applied by the nozzles (60) of the first series wets the web (2) upstream of a pre-incision line, while the glue (G7) applied by the nozzles (70) of the second series wets the web (2) downstream of the same pre-incision line.

Therefore, when the web (2) is torn in correspondence of the pre-incision line, as disclosed below, the glue (G7) results on an edge of the last sheet (21) of a log (RO) in formation, while the glue (G6) allows the first sheet (20) of a new log to be formed on the core (1) to adhere to the latter.

For example, the interruption of the web (2) at said pre-incision line can be determined by nozzles (U4) intended to blow compressed air and inserted into the roller (R4) whose jacket is perforated. A device of this type is disclosed in WO2004/096 684.

In the station for the formation of logs (RO) where, in known manner, are operated the roller (R5) and (R6), the web (2) is wound on core (1). The winding starts with the adhesion of the web (2) on core (1) thanks to the glue (G7) applied by the nozzles (70) of the second series and ends with the adhesion of the last sheet (21) of the log (RO) in formation on the underlying sheet due to the glue (G6) applied by the nozzles (60) of the first series.

Thanks to the present invention, the glue (G6) destined to the so-called flap-closing is distributed on the core (1) by forming glue lines oriented towards the glue lines (G7) destined to allow the adhesion of the paper web (2) to the core (1), while the glue lines (G7) are oriented towards the glue lines (G6). Thus, it is obtained a better finished product (RO) that does not exhibit glue on not desired points.

A method according to the present invention therefore comprises the following steps:

- supplying in sequence more tubular cores (1) along a predetermined advancing direction (A);
- applying on each of said cores (1) a predetermined amount of glue on a first point (P6) and on a second point (P7);
- orienting the glue (G6) applied on the first point (P6) towards the second point (P7) and along said advancing direction (A);
- orienting the glue (G7) applied on the second point (P7) towards the first point (P6) and along a direction opposite relative to said advancing direction (A).

In the example described above the orientation of the glue (G6, G7) is obtained by means of bodies (62, 72) that come into contact with the core (1) in said first and said second point (P6; P7) and which oblige the core (1) to rotate about its longitudinal axis first in a direction opposite to said advancing direction (A) and then to rotate according to said advancing direction. Consequently, the glue (G6) applied in the first point (P6) is oriented along the advancement direction (A), and the glue (G7) applied in the second point (P7) is oriented in the opposite direction with respect to the advancement direction (A).

Furthermore, the said bodies (62, 72) are positioned along the direction (A) of advancement of the cores.

In addition, according to the example described above, the cores (1) are made to advance by means of the belts (4, 5). It is understood, however, that any other core advancement means can be provided.

Furthermore, at any time more than one core (1) can result along the gluing path, even if the attached drawings show only one core (1) between the belts (4, 5).

The invention claimed is:

1. A method for applying glue on tubular cores for producing logs of paper material, the method comprising the steps of:

- supplying in sequence tubular cores along a predetermined advancing direction;
- applying a predetermined amount of glue on a first point on each of said tubular cores;
- spreading said glue applied on said first point along said predetermined advancing direction;
- applying a predetermined amount of glue on a second point on each of said tubular cores; and
- spreading said glue applied on said second point along a direction opposite said predetermined advancing direction such that said glue applied on said first point is oriented towards said second point and said glue applied on said second point is oriented towards said first point.

2. A method according to claim 1, wherein spreading of said glue is performed by members acting by contact on the tubular cores.

3. A method according to claim 1, wherein said tubular cores are made to advance along said predetermined advancing direction by a driving means that engages the tubular cores on two opposed sides.

4. A method according to claim 1, wherein spreading of said glue is performed while advancement of the tubular cores along said predetermined advancing direction is temporarily interrupted and while the advancement of the tubular cores is temporarily interrupted the tubular cores are made to rotate around longitudinal axes of the tubular cores in the direction opposite said predetermined advancing direction during spreading of the glue applied on the first point and according to the predetermined advancing direction during the spreading of the glue applied on the second point.

5. A device for distributing glue on tubular cardboard cores, the device comprising:

- a means for feeding in sequence tubular cores along a predetermined advancing direction;
- a gluing means for dispensing a predetermined amount of glue on a first point and on a second point on each of said tubular cores;
- a spreading means for spreading the glue provided on the first point towards the second point and for spreading the glue supplied on the second point towards the first point, said spreading means of the glue being arranged and acting along said predetermined advancing direction to orient the glue applied on the first point according to said predetermined advancing direction and to orient the glue applied on the second point along a direction opposite to the predetermined advancing direction.

6. A device according to claim 5, wherein said spreading means for spreading the glue is a means acting by contact on the tubular cores.

7. A device according to claim 6, wherein said spreading means for spreading the glue comprises two surfaces, one of said two surfaces being downstream of a first nozzle configured to deliver the glue on said first point and said one of said two surfaces being upstream of a second nozzle configured to deliver the glue on the second point, another one of said two surfaces being downstream of said second nozzle.

8. A device according to claim 5, wherein the means for feeding the tubular cores comprises a series of superimposed driving belts, oriented along said predetermined advancing direction and said series of superimposed driving belts being mutually arranged such that the tubular cores are engaged between two opposite sections of the superimposed driving belts.

9. A device according to claim 5, wherein said spreading means for spreading the glue is arranged and acts between said means for feeding the tubular cores.

10. A device according to claim 6, wherein said spreading means for spreading the glue is arranged and acts between said means for feeding the tubular cores.

11. A device according to claim 7, wherein said spreading means for spreading the glue is arranged and acts between said means for feeding the tubular cores.

12. A device according to claim 8, wherein said spreading means for spreading the glue is arranged and acts between said means for feeding the tubular cores.

13. A method for applying glue on cores for producing logs of paper material, the method comprising:

- supplying cores along a predetermined feed direction;
- depositing glue on a first area of each of said cores;
- rotating one of said cores in a first direction such that said glue deposited on said first area forms a first elongated glue area;
- depositing glue on a second area of said one of said cores;
- rotating said one of said cores in a second direction such that said glue deposited on said second area forms a second elongated glue area, said second direction being opposite said first direction.

14. A method according to claim 13, wherein said first elongated glue area extends in a direction of said second elongated glue area and said second elongated glue area extends in a direction of said first elongated glue area.

15. A method according to claim 13, wherein said first elongated glue area is located at a spaced location from said second elongated glue area.

16. A method according to claim 13, wherein said first direction is opposite the predetermined feed direction and said second direction is in a direction of the predetermined feed direction.

17. A method according to claim 13, wherein said glue deposited on said first area is spread in a direction of said predetermined feed direction via rotation of one of said cores in said first direction to form said first elongated glue area and said glue deposited on said second glue area is spread in a direction opposite said predetermined feed direction via rotation of one of said cores in said second direction to form said second elongated glue area.

18. A method according to claim 13, further comprising:

providing a first roller; and providing a second roller, said first roller rotating said one of said cores in said first direction, said second roller rotating said one of said cores in said second direction.

19. A method according to claim 18, wherein said first roller is located upstream of said second roller with respect to said predetermined feed direction.

20. A method according to claim 18, wherein said first roller is located at a spaced location from said second roller.

* * * * *